US005639984A

United States Patent [19]

Nielson

[11] Patent Number: 5,639,984

[45] Date of Patent: Jun. 17, 1997

[54] INFRARED TRACER COMPOSITIONS

[75] Inventor: Daniel B. Nielson, Brigham City, Utah

[73] Assignee: Thiokol Corporation, Ogden, Utah

[21] Appl. No.: 651,617

[22] Filed: May 22, 1996

Related U.S. Application Data

[63] Continuation of Ser. No. 405,260, Mar. 14, 1995, abandoned.

[51] Int. Cl.[6] ..... F42B 4/26

[52] U.S. Cl. ..... 102/336; 149/116; 149/19.1; 149/61; 149/75; 149/35

[58] Field of Search ..... 102/335, 336; 149/116, 19.1, 22, 61, 75, 35, 110

[56] References Cited

U.S. PATENT DOCUMENTS

| | | | |
|---|---|---|---|
| 2,706,611 | 12/1955 | Hastings . | |
| 2,909,418 | 10/1959 | Pearsall . | |
| 3,257,801 | 6/1966 | Martinez et al. . | |
| 3,411,964 | 11/1968 | Donda . | |
| 3,475,237 | 10/1969 | Lane et al. . | |
| 3,485,169 | 12/1969 | Lai . | |
| 3,537,923 | 11/1970 | Gould et al. . | |
| 3,617,403 | 11/1971 | Johnson . | |
| 3,634,153 | 1/1972 | Perkins et al. . | |
| 3,673,013 | 6/1972 | Lane et al. . | |
| 3,677,842 | 7/1972 | Doris . | |
| 3,723,206 | 3/1973 | Dinsdale et al. . | |
| 3,733,223 | 5/1973 | Lohkamp . | |
| 3,770,525 | 11/1973 | Villey-Desmeserets . | |
| 3,883,373 | 5/1975 | Sidebottom | 149/6 |
| 3,888,177 | 6/1975 | Tyroler . | |
| 3,895,578 | 7/1975 | Shaw et al. . | |
| 3,951,705 | 4/1976 | Mancinelli et al. . | |
| 3,954,529 | 5/1976 | Reed et al. . | |
| 3,983,816 | 10/1976 | Cornia et al. . | |
| 3,986,907 | 10/1976 | Dillehay . | |
| 4,072,546 | 2/1978 | Winer | 149/19.8 |
| 4,078,954 | 3/1978 | Bernardy . | |
| 4,204,895 | 5/1980 | Webster, III . | |
| 4,406,228 | 9/1983 | Boettcher et al. . | |
| 4,508,580 | 4/1985 | Klöber . | |
| 4,528,911 | 7/1985 | DePhillipo et al. . | |
| 4,547,235 | 10/1985 | Schneiter et al. | 149/35 |
| 4,597,810 | 7/1986 | Trickel et al. | 149/15 |
| 4,719,857 | 1/1988 | Spring . | |
| 4,881,464 | 11/1989 | Sayles . | |
| 5,056,435 | 10/1991 | Jones et al. . | |
| 5,317,163 | 5/1994 | Obkircher . | |

FOREIGN PATENT DOCUMENTS

| | | |
|---|---|---|
| 1277528 | 10/1970 | United Kingdom . |
| 1515039 | 6/1976 | United Kingdom . |
| 1573645 | 4/1977 | United Kingdom . |
| 2176178A | 12/1986 | United Kingdom . |

*Primary Examiner*—Charles T. Jordan
*Assistant Examiner*—John R. Hardee
*Attorney, Agent, or Firm*—Cushman Darby & Cushman IP Group of Pillsbury Madison & Sutro, LLP; Ronald L. Lyons, Esq.

[57] ABSTRACT

Convert infrared tracer compositions are provided. The compositions are formed using peroxide such as strontium peroxide and barium peroxide. Added to these materials is a burn rate catalyst such as boron, iron oxide, cupric oxide, manganese dioxide, carbon, silicon, graphite fibrils, amorphous silica, copper oxide, potassium dodecaborate, the dipotassium salt of bitetrazole amine, and the potassium salt of dilituric acid. The composition also includes alkali metal compounds in order to enhance the infrared emissions. The compositions are bound together using a binder such that the composition results in a granular material having a mean particle size in the range of from about 500μ to about 800μ.

15 Claims, No Drawings

INFRARED TRACER COMPOSITIONS

This application is a continuation of U.S. application Ser. No. 08/405,260, filed Mar. 14, 1995, for Infrared Tracer Compositions, now abandoned.

BACKGROUND

1. The Field of the Invention

The present invention is related to infrared tracer compositions which are capable of producing a consistent infrared output when fired from a rifle or other weapon or launch system. More particularly, the present invention relates to infrared tracer compositions which burn reliably and do not require additional igniters for initiation.

2. Technical Background

Tracers bullets and other projectiles are often used in combat and training situations. Tracer bullets provide a visual trace of the path of a projectile. They also provide a relatively reliable means of gauging whether the projectiles fired are impacting upon the desired target or whether adjustments in aim are required.

One of the problems with the use of tracer bullets which emit visible light is that the location of the source of the trace bullet is also discernable. Thus, it is possible for an enemy to visually locate the source of the tracer bullet and to direct a counter-attack toward that location.

For this reason, there has been great interest in the development of tracers that are not visible to the naked human eye. With the development of infrared detection systems, such as night vision goggles, there has been interest in developing tracers which emit infrared light, but which emit little or no visible light. At the same time, it is necessary to tailor the infrared emission such that it is not overly intense at any particular point because very high intensity infrared light could temporarily blind an observer using an infrared detection system.

As early as the 1940's, the United States Army was at work developing "dim" tracer formulations. Dim tracer formulations were generally formulations which gave off only limited visible light, but which emitted significant infrared light. One early formulation designated by the Army as I-136 generally comprised 90.0% strontium peroxide, 10% calcium resonate, and up to about 6.0% magnesium. This formulation, however, had a number of limitations in terms of performance and output.

Eventually the United States Army developed an improved dim tracer formulation designated R-440. This composition is generally comprised of about 40% strontium peroxide, 40% barium peroxide, 10% calcium resinate, and 10% magnesium carbonate.

While R-440 was an improvement over the existing art at the time, the composition presents a number of limitations. For example, the formulation suffers from unreliable ignition. This requires the use of an igniter or an ignition composition associated with the R-440 composition. The ignition composition adds to the complexity and cost of manufacture, and also tends to produce additional visible light during the firing of the tracer.

An addition problem is that R-440 provides a smaller than ideal infrared light output. The composition has a relatively low level near infrared intensity which limits the visibility of the tracer at extended ranges. That is, as the tracer travels closer to the target, the infrared output tends to diminish.

A further problem with R-440 is that the material is a powder. Several problems arise when processing an energetic material in powdered form. It is sometimes observed, for example, that as much as 40% of the material is lost during processing. This is clearly a huge drawback to the use of R-440 and results in a substantial increase in the cost of the product. Furthermore, the small particle size produced by the use of calcium resonate as a binder presents a safety concern. The small powdery particles of the material provide large amounts of surface area which make the material more prone to accidental ignition.

It is desirable in many contexts to provide a tracer that is not only "dim" but which is also "covert." That is, rather than emitting small amounts of visible light, the tracer is essentially free of visible emissions. Convert tracers operate in the same general manner as conventional red, green, and white visible tracers, except that covert tracers produce no visible signature. The achievement completely covert performance has been difficult with conventional formulations.

Accordingly, it would be a substantial advancement in the art to provide covert tracer compositions which overcame some of the problems encountered in the art. It would be an advancement in the art to provide tracer compositions which did not require igniters or ignition compositions in order to operate. It would be a further advancement in the art to provide tracer compositions which had augmented near infrared intensity when compared with conventional compositions. It would be an additional advancement in the art to provide compositions which were not in powder form and which avoided the use of hazardous compositions, such as ozone depleting solvents. It would also be an advancement in the art to provide covert tracer compositions which were safer to use and less sensitive to accidental ignition than conventional tracer compositions.

Such compositions are disclosed and claimed herein.

BRIEF SUMMARY AND OBJECTS OF THE INVENTION

The present invention relates to tracer compositions designed especially for use in 5.56 mm, 7.62 mm, 50 caliber, 20 mm, and 30 mm small caliber munitions. The compositions may also be adaptable for other tracer applications. These compositions are also designed to reduce the loss of night vision normally associated with firing tracers. Since these materials are covert and produce essentially no detectable visible light upon firing, they avoid revealing the source of the tracer.

The compositions of the present invention are able to augment near infrared emissions when fired. This is accomplished by the addition of infrared producing alkali metal salts as oxidizers and fuels in the composition. Such materials may, for example, include potassium, cesium, and rubidium nitrates and perchlorates. In addition, the compositions may include potassium, rubidium, and cesium salts of materials such as bitetrazole amines (BTA), cyanates, sebacic acid, azides, oxalic acid, bicarbonates, 3-nitro-1,2,4,-triazol-5-one (NTO), thiocyanate, carboxylic acids, and similar materials.

The present invention also teaches the addition of one or more binders. The binders act to bind the entire composition together. In conventional tracer compositions, the binder has typically been calcium resinate. However, using calcium resinate, a powdery composition is formed. This results in loss of material during processing and increased danger of accidental ignition due to the small particle size/large surface area created. Therefore, it is presently preferred within the scope of the present invention to avoid the use of calcium resinate as a binder.

Using the binders taught by the present invention it is possible to process the compositions using aprotic solvents. One of the further problems in the art has been the use of protic solvents which can cause the composition to degrade over time. Aprotic solvents, conversely, are generally less likely to cause product degradation and may also be safer and more environmentally friendly. Examples of solvents which fall within the scope of the present invention include methyl and ethyl acetate, acetone, and methyethyl ketone.

A further novel feature of the present invention is the addition of a burn rate catalyst to the covert tracer composition. The burn rate catalyst is selected such that it improves ignition reliability and enhances combustion under rigorous ballistic conditions. Such burn rate catalysts include boron, iron oxide, cupric oxide, manganese dioxide, carbon, silicon, graphite fibrils, amorphous silica, copper oxide, potassium dodecaborate, the dipotassium salt of bitetrazole amine ($K_2BTA$), the potassium salt of dilituric acid, or mixtures thereof. Use of a burn rate catalyst helps provide a composition which burns rapidly to completion and which does not require a separate ignition composition, as is conventional in this art.

The compositions of the present invention also include one or more peroxides. Presently preferred peroxides include strontium peroxide and barium peroxide; however, other peroxides may also be used. Peroxides also aid in assuring that the composition burns rapidly to completion under ballistic conditions.

Using the present invention, compositions are provided which overcome some of the problems encountered in the art. The tracer compositions of the present invention do not require igniters or ignition compositions in order to operate. The compositions also have augmented near infrared intensity when compared to conventional compositions.

Importantly, it is also possible to make the compositions in granular form rather than powder form. This allows manufacture and use of the tracer compositions with a minimum of material loss and an increase in safety. At the same time, the compositions of the present invention allow for the use of non-hazardous and non-degrading solvents.

These and other objects and advantages of the invention will become apparent upon reading the following detailed description and appended claims.

DETAILED DESCRIPTION OF THE PREFERRED EMBODIMENTS

The present invention is related to significant improvements in covert infrared tracer formulations. The formulations of the present invention overcome a number of the persistent problems encountered in the art.

One of the advantages of the present invention is an increase in the infrared output of the compositions. As was mentioned above, it is desirable to have a consistent infrared trace from firing to impact. This improvement is accomplished in part by the addition of from about 0.5% to about 55% by weight alkali metal compounds in the formulation.

Alkali metals may be added to the compositions in any form which is compatible with the other components of the compositions. For example, the composition may include potassium, rubidium, and cesium nitrates, perchlorates, or mixtures thereof. Furthermore, alkali metal carbonates, bicarbonates, citrates, sorbates, oxalates, dicarboxylic acids, cyanates, thionates, azides, ferrocyanates and acetates, tetrazoles, and bitrazole amines are also preferred forms of the alkali metal. For example, potassium bitetrazole amine has been found to provide acceptable results.

It is observed that the addition of alkali metal salts significantly increases the plume size of the tracer and dramatically improves the near infrared emission over conventional compositions. The increased plum size and high near infrared intensity greatly improves the tracer performance. These additives significantly improve the visibility, when viewed through night vision devices. The compositions of the present invention can be detected at greater distances than existing compositions such as R-440. This greater near infrared performance is achieved while eliminating substantially all visible light. Thus, the compositions of the present invention can be characterized as "covert," as that term is used herein.

The present invention also includes the addition of from about 0.5% to about 10% burn rate catalyst. The burn rate catalyst improves ignition and sustains the combustion of the covert tracer formulation during firing. This avoids the need for additional igniters and ignition compositions, and also avoids the problem of flame loss during use. These problems have been common when using existing compositions.

Presently preferred burn rate catalysts include boron, iron oxide, cupric oxide, manganese dioxide, carbon, silicon, graphite fibrils, amorphous silica, copper oxide, potassium dodecaborate, the dipotassium salt of bitetrazole amine, the potassium salt of dilituric acid, or mixtures thereof. The addition of burn rate catalysts increases the infrared plume during use. As mentioned above, the use of the burn rate catalyst helps eliminate the need for visible light producing ignition compositions such as I-136.

The present invention also employs improved fuels/binders, and associated solvent systems which are distinct from those typically used in conventional tracers. One fuel that is sometimes preferred is lactose. Lactose has a low melting point which is important during processing. It also has a good fuel value. The use of organic fuels, such as lactose also contributes to the large plume size due to after burning.

Binders are used which are capable of producing a granular product. This is to be distinguished from the powdery R-440 product. Binders which produce a granular product are well known in the art. Generally, such binders produce a hard product and may be thermoplastic in nature or may be cured during processing. The exact size of the product can be selected during processing. However, a hard plastic material that is impervious to moisture is presently preferred. Examples of such binders include nylon[1], VAAR (vinylacetate alcohol resin) commercially available from Union Carbide, Viton A commercially available from DuPont, HyCAR available from Zeon Chemicals, and polypropylene carbonate.

[1] Nylon was formerly a trademark of DuPont and refers to a group of polymers which are generally combinations of diamines and dicarboxylic acids. The most common type of nylon is synthesized from adipic acid and hexamethylene diamine. Nylons are well known and commercially available.

Generally from about 1% to about 20% by weight binder is preferred in the composition. For most applications, from about 2% to about 10% by weight binder is preferred, with from about 2% to about 6% by weight being the most preferred range. As mentioned above, it is preferred that the binder produce a hard granular material, instead of the powder of conventional compositions. The size of the granular particles may be selected during processing by well known techniques. Generally, the granules will have particle sizes in the range of from about 500μ to about 800μ. For purposes of this discussion, particles having sizes in this range will be consider "granular" in nature and will fall within the scope of the present invention.

One of the other advantages of the binders of the present invention is that more desirable solvent systems can be used in association with these binders. Conventional binder systems for tracer compositions use carbon tetrachloride, which is acidic, a suspected carcinogen, and an environmental hazard. In the present invention, it is generally preferred that any solvent be generally aprotic and less acidic than conventional solvents. This lessens degradation of the composition over time. It also helps in avoiding environmental problems associated with the processing and use of the tracer compositions.

The compositions of the present invention rely on peroxides as a primary component. Generally, the compositions of the present invention will include from about 30% to about 98% by weight of at least one peroxide. Exemplary peroxides include strontium peroxide, barium peroxide, mixtures of strontium peroxide and barium peroxide, and other peroxides which are compatible with the other components of the composition.

It is found that the use of substantial quantities of peroxides, together with the other components of the compositions, result in complete burning and good performance of the compositions.

EXAMPLES

The following examples are given to illustrate various embodiments which have been made or may be made in accordance with the present invention. These examples are given by way of example only, and it is to be understood that the following examples are not comprehensive or exhaustive of the many types of embodiments of the present invention which can be prepared in accordance with the present invention.

Example 1

In this example a composition within the scope of the present invention was formulated from the following ingredients, expressed in weight percent:

| Material | Weight % |
|---|---|
| Strontium peroxide | 40.0 |
| Barium peroxide | 40.0 |
| Boron | 0.5 |
| Potassium oxalate | 10.0 |
| Lactose | 5.5 |
| VAAR | 4.0 |

This composition produced a covert tracer composition that was placed within a tracer round and fired. The tracer round was observed to produce an infrared trace throughout the test firing.

Example 2

In this example a composition within the scope of the present invention was formulated from the following ingredients, expressed in weight percent:

| Material | Weight % |
|---|---|
| Strontium peroxide | 40.0 |
| Barium peroxide | 40.0 |
| Silica | 5.0 |
| Lactose | 6.0 |
| Potassium oxalate | 7.0 |
| VAAR | 2.0 |

This composition produced a covert tracer composition that was placed within a tracer round and fired. The tracer round was observed to produce an infrared trace throughout the test firing.

Example 3

In this example a composition within the scope of the present invention was formulated from the following ingredients, expressed in weight percent:

| Material | Weight % |
|---|---|
| Barium peroxide | 41.5 |
| Cesium nitrate | 41.5 |
| Silicon | 5.0 |
| Boron | 3.0 |
| Potassium oxalate | 5.0 |
| VAAR | 4.0 |

This composition produced a covert tracer composition that was placed within a tracer round and fired. The tracer round was observed to produce an infrared trace throughout the test firing.

Example 4

In this example a composition within the scope of the present invention was formulated from the following ingredients, expressed in weight percent:

| Material | Weight % |
|---|---|
| Strontium peroxide | 40.0 |
| Barium peroxide | 40.0 |
| $K_2BTA$ | 5.0 |
| Lactose | 10.0 |
| Magnesium carbonate | 1.0 |
| VAAR | 4.0 |

This composition produced a covert tracer composition that was placed within a tracer round and fired. The tracer round was observed to produce an infrared trace throughout the test firing.

All of the above examples using VAAR were mixed in an acetone or ethylacetate slurry. Ethanol may be used, but aprotic solvents, such as ethylacetate and acetone, are the preferred solvents. As was discussed above, protic solvents, such as methanol and ethanol, may aid in the decomposition of the barium and strontium peroxides.

SUMMARY

In summary, the present invention provides covert infrared tracer compositions which overcome some of the problems encountered in the art. In particular, the compositions of the present invention do not require igniters or ignition compositions in order to operate. The compositions of the present invention provide tracer compositions which have augmented near infrared intensity when compared with conventional compositions. The compositions may also be processed while avoiding the use of hazardous compositions, such as ozone depleting solvents. Because of the fact that the compositions are granular rather than in powdered form, they are safer to use and less sensitive to accidental ignition than conventional tracer compositions.

The invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. An infrared tracer composition comprising:

from about 30% to about 98% by weight of at least one peroxide;

from about 1% to about 20% by weight binder;

from about 0.5% to about 15% by weight burn rate catalyst; and from about 0.5% to about 55% by weight alkali metal compound, said alkali metal compound being selected from the group consisting of alkali metal perchlorates, bitetrazole amines, cyanates, sebacic acids, azides, oxalic acids, bicarbonates, 3-nitro-1,2,4,-triazol-5-ones, thiocyanates, carboxylic acids, and mixtures thereof.

2. An infrared tracer composition as defined in claim 1 wherein said binder is selected such that the composition is granular in consistency having a mean particle size in the range of from about 500μ to about 800μ.

3. An infrared tracer composition as defined in claim 1 wherein said binder is a vinylacetate alcohol resin binder.

4. An infrared tracer composition as defined in claim 1 wherein said binder is nylon.

5. An infrared tracer composition as defined in claim 1 further comprising an alkali metal nitrate.

6. An infrared tracer composition as defined in claim 1 wherein said burn rate catalyst is boron.

7. An infrared tracer composition as defined in claim 1 wherein said burn rate catalyst is silicon.

8. An infrared tracer composition as defined in claim 1 wherein said burn rate catalyst is selected from the group consisting of boron, iron oxide, cupric oxide, manganese dioxide, carbon, silicon, graphite fibrils, amorphous silica, copper oxide, potassium dodecaborate, the dipotassium salt of bitetrazole amine, the potassium salt of dilituric acid, or mixtures thereof.

9. An infrared tracer composition as defined in claim 1 wherein said peroxide is selected from the group consisting of strontium peroxide, barium peroxide, or mixtures thereof.

10. An infrared tracer composition comprising:

from about 30% to about 98% by weight of at least one peroxide;

from about 1% to about 20% by weight binder, wherein said binder is selected such that the composition is granular in consistency having a mean particle size in the range of from about 500μ to about 800μ;

from about 0.5% to about 15% burn rate catalyst selected from the group consisting of boron, iron oxide, cupric oxide, manganese dioxide, carbon, silicon, graphite fibrils, amorphous silica, copper oxide, potassium dodecaborate, the dipotassium salt of bitetrazole amine, the potassium salt of dilituric acid, or mixtures thereof; and from about 0.5% to about 55% alkali metal compound, wherein said alkali metal compound is selected from the group consisting of alkali metal perchlorates, bitetrazole amines, cyanates, sebacic acids, azides, oxalic acids, bicarbonates, 3-nitro-1,2,4,-triazol-5-ones (BTA), thiocyanates, carboxylic acids, and mixtures thereof.

11. An infrared tracer composition as defined in claim 10 wherein said binder is a vinylacetate alcohol resin binder.

12. An infrared tracer composition as defined in claim 10 wherein said binder is nylon.

13. An infrared tracer composition as defined in claim 10 wherein said peroxide is selected from the group consisting of strontium peroxide, barium peroxide, or mixtures thereof.

14. An infrared tracer composition comprising:

from about 30% to about 98 % by weight peroxide selected from the group consisting of strontium peroxide, barium peroxide, or mixtures thereof;

from about 1% to about 20% by weight binder, wherein said binder is selected such that the composition is granular in consistency having a mean particle size in the range of from about 500μ to about 800μ;

from about 0.5% to about 15% burn rate catalyst; and from about 0.5% to about 55% alkali metal compound, wherein said alkali metal compound is selected from the group consisting of alkali metal perchlorates, bitetrazole amines, cyanates, sebacic acids, azides, oxalic acids, bicarbonates, 3-nitro-1,2,4,-triazol-5-ones (BTA), thiocyanates, carboxylic acids, and mixtures thereof.

15. An infrared tracer composition as defined in claim 14 wherein said burn rate catalyst is selected from the group consisting of boron, iron oxide, cupric oxide, manganese dioxide, carbon, silicon, graphite fibrils, amorphous silica, copper oxide, potassium dodecaborate, the dipotassium salt of bitetrazole amine, and the potassium salt of dilituric acid, or mixtures thereof.

* * * * *